US008052545B1

(12) United States Patent
Assenheimer, III

(10) Patent No.: US 8,052,545 B1
(45) Date of Patent: Nov. 8, 2011

(54) SPORTS TRAINING DEVICE

(76) Inventor: Scott Assenheimer, III, Longview, TX (US)

( * ) Notice: Subject to any disclaimer, the term of this patent is extended or adjusted under 35 U.S.C. 154(b) by 470 days.

(21) Appl. No.: 12/287,400

(22) Filed: Oct. 9, 2008

(51) Int. Cl.
*A63B 69/00* (2006.01)

(52) U.S. Cl. ..... 473/446; 473/422

(58) Field of Classification Search ..... 473/184, 473/446; 273/381; D21/699
See application file for complete search history.

(56) References Cited

U.S. PATENT DOCUMENTS

| | | | | | |
|---|---|---|---|---|---|
| 157,363 | A * | 12/1874 | Bedford | 273/381 |
| 854,640 | A * | 5/1907 | Fuller | 273/381 |
| 2,264,127 | A * | 11/1941 | Thorstein | 273/381 |
| 3,328,033 | A * | 6/1967 | Hendry | 473/184 |
| 3,963,240 | A * | 6/1976 | Tidwell | 273/381 |
| 4,092,023 | A | 5/1978 | Hazen | 273/26 A |
| 4,607,842 | A | 8/1986 | Daoust | 273/1 B |
| 4,842,283 | A | 6/1989 | LeBel et al. | 273/392 |
| 4,921,257 | A | 5/1990 | Heller | 273/401 |
| 5,181,725 | A | 1/1993 | Leras et al. | 273/402 |
| 5,290,043 | A | 3/1994 | Vidinic | 273/411 |
| 5,503,402 | A | 4/1996 | Moss, Jr. | 273/400 |
| 5,628,515 | A | 5/1997 | Levy | 473/446 |
| 5,634,640 | A | 6/1997 | McCarrel | 473/446 |
| 5,813,928 | A * | 9/1998 | Hsieh | 473/480 |
| D449,084 | S | 10/2001 | Walters | D21/705 |
| 6,695,724 | B2 | 2/2004 | Birss | 473/446 |
| 7,134,976 | B1 | 11/2006 | Smith | 473/446 |
| 7,407,452 | B1 * | 8/2008 | Gawthrop | 473/446 |
| 2008/0076606 | A1 * | 3/2008 | Siefker | 473/446 |
| 2008/0214331 | A1 * | 9/2008 | Talafous et al. | 473/446 |

* cited by examiner

*Primary Examiner* — Gene Kim
*Assistant Examiner* — M Chambers
(74) *Attorney, Agent, or Firm* — R. Keith Harrison

(57) ABSTRACT

A sports training device which is suitable for developing skills in sports in which attempts are made by players of opposing teams to maneuver a ball, puck or other object into a goal of the opposing team includes a target support frame, a device attachment assembly carried by the target support frame for attaching the device to the goal, a device anchor assembly carried by the target support frame for anchoring the device in the ground or other surface and at least one target carried by the target support frame between the device attachment assembly and the device anchor assembly.

9 Claims, 6 Drawing Sheets

SPORTS TRAINING DEVICE

FIELD

The present disclosure generally relates to devices for developing sporting skills. More particularly, the present disclosure relates to a sports training device which is suitable for developing skills in sports in which attempts are made by players of opposing teams to maneuver a ball, puck or other object into a goal of the opposing team.

BACKGROUND

Several popular team sports utilize goals in which each of two teams attempts to place a ball or other object in the goal of the opposing team. Each team defends its own goal by attempting to prevent placement of the ball or other object into that team's goal by the opposing team. For example, in soccer the players of opposing teams attempt to maneuver a ball downfield and into the goal of the opposing team by kicking the ball. In hockey, a puck is maneuvered on an ice rink by striking of the puck with a hockey stick, whereas in lacrosse, a ball is thrown downfield by tossing and catching of the ball by the players using lacrosse sticks. In these types of sports, a "goalie" or goalkeeper stands in front of each team's goal and defends the goal by attempting to deflect the ball or puck from the interior of the goal as the players on each team attempt to place the ball or puck in the opposing team's goal.

These types of sports may present several challenges to coaches as they teach athletes to improve and repeat skills in maneuvering the ball or other object into an opposing team's defended goal. Because the goalkeeper is typically positioned at the center portion of the goal opening during play, the tendency, particularly for young athletes, is to aim directly at the goalkeeper as though the goalkeeper were the target. Therefore, athletes may be coached to maneuver the ball or other object into the areas of the goal opening which are most difficult for the goalkeeper to defend (typically the upper and lower corners of the goal opening).

Therefore, a sports training device which is suitable for developing skills in maneuvering a ball or other object into an area of a goal which is difficult for a goalkeeper to defend is desirable.

SUMMARY

The present disclosure is generally directed to a sports training device which is suitable for developing skills in sports in which attempts are made by players of opposing teams to maneuver a ball, puck or other object into a goal of the opposing team. An illustrative embodiment of the sports training device includes a target support frame, a device attachment assembly carried by the target support frame for attaching the device to the goal, a device anchor assembly carried by the target support frame for anchoring the device in the ground or other surface and at least one target carried by the target support frame between the device attachment assembly and the device anchor assembly.

BRIEF DESCRIPTION OF THE DRAWINGS

The disclosure will now be made, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure which is defined by the claims. Furthermore, there is no intention to be bound by any expressed or implied theory presented in the preceding technical field, background, brief summary or the following detailed description.

Figure 4:
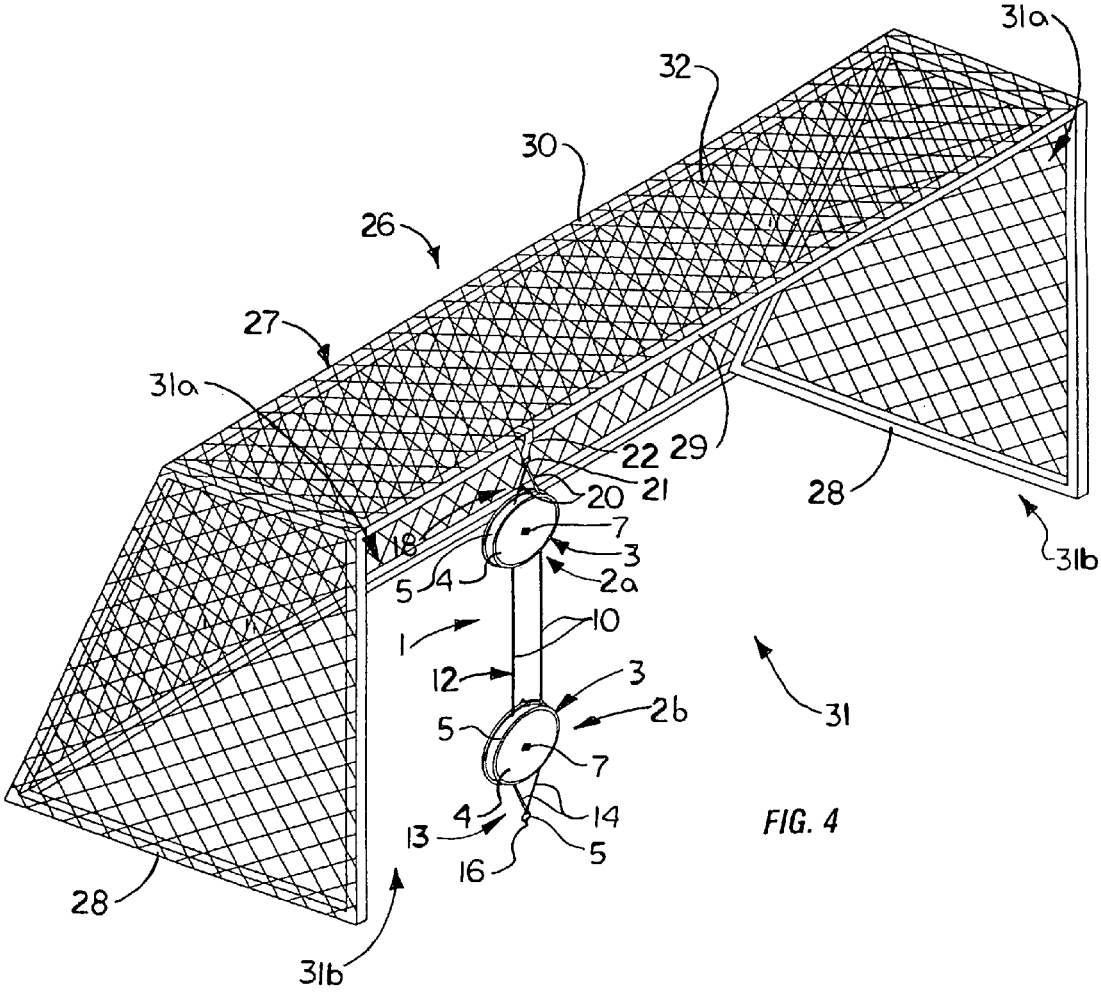
FIG. 4 is a front perspective view of a goal, with an illustrative embodiment of the sports training device deployed in a functional configuration on the goal.

Referring initially to FIG. 4 of the drawings, an illustrative embodiment of the sports training device is generally indicated by reference numeral 1. An exemplary goal 26 which is suitable for implementation of the sports training device 1 is illustrated in FIG. 4. The goal 26 may be of the type which is suitable for use in any type of game in which players (not illustrated) on each of two opposing teams attempt to maneuver a ball, puck or other object (not illustrated) into a goal opening 31 in the goal 26 of the opposing team. Examples of games which may utilize the goal 26 in application of the sports training device 1 include soccer, hockey and lacrosse, for example and without limitation. The goal 26 may include a goal frame 27 having a pair of spaced-apart goal frame side members 28. A front goal frame member 29 and a rear goal frame member 30 may extend between the goal frame side members 28. Goal netting 32 may be provided on the goal frame 27. However, it will be understood that the goal 26 which is used in implementation of the sports training device 1 may have a design which departs from that of the goal 26 illustrated in FIG. 4.

As will be hereinafter further described, the sports training device 1 may be suspended from the goal frame 27 in front of the goal opening 31 and may include at least one target 2. In some embodiments, the sports training device 1 may include an upper target 2*a* and a lower target 2*b* which are disposed in spaced-apart relationship with respect to each other. In typical application of the sports training device 1, which will be hereinafter further described, from outside the goal 26 a user (not illustrated) may attempt to maneuver a ball, puck or other object (not illustrated) toward the goal opening 31 and against the upper target 2*a* or the lower target 2*b* of the sports training device 1 such as by kicking of a ball (not illustrated), striking of a puck (not illustrated) using a hockey stick (not illustrated) or tossing of a ball toward the goal opening 31 using a lacrosse stick (not illustrated), for example and without limitation. Repeated attempts at maneuvering the ball, puck or other object against the upper target 2*a* or the lower target 2*b* may facilitate training or conditioning of the player to maneuvering the ball, puck or other object into the goal opening 31 at a location or locations within the goal opening 31 which may be difficult for a goalkeeper (not illustrated) to defend or deflect the ball, puck or other object to prevent entry of the ball, puck or object into the goal opening 31 during a game. To this end, the position of the sports training device 1 along the goal frame 27 may be selected to locate the upper target 2*a* and the lower target 2*b* at desired positions within the goal opening 31. For example and without limitation, as will be hereinafter described, in some applications, the sports training device 1 may be positioned such that the upper target 2*a* and the lower target 2*b* are located generally in the area of an upper corner 31*a* and a lower corner 31*b*, respectively, of the goal opening 31.

Referring next to FIGS. 1A-3B and 7 of the drawings, the sports training device 1 includes a target support frame 12 which may be adapted for attachment to the goal frame 27 (FIG. 4) of the goal 26 such as in a manner which will be hereinafter described. At least one target 2 is provided on the target support frame 12. The target support frame 12 may be any type of supporting structure which is suitable for attachment to the goal frame 27 (FIG. 4) of the goal 26 and facilitates support or suspension of the target or targets 2 in front of the goal opening 31 of the goal 26. The elements of the target support frame 12 may be a rigid or semi-rigid material or alternatively, may be a flexible material such as rope or cord, for example and without limitation. As illustrated in FIGS. 1A, 1B, 2A and 3A, in some embodiments the target support frame 12 may include a target suspension member 20 which is attached to the target or targets 2 such as in a manner which will be hereinafter described and facilitates attachment of the target or targets 2 to the goal 26 (FIG. 4). The target support frame 12 may also include a target anchor member 14 which is attached to the target or targets 2 such as in a manner which will be hereinafter described and facilitates anchoring of the sports training device 1 to a goal supporting surface 40 (FIG. 8) such as the ground or an ice rink, for example and without limitation.

In some embodiments of the sports training device 1, an upper target 2*a* and a lower target 2*b* are disposed in spaced-apart relationship with respect to each other on the target support frame 12. Accordingly, the target suspension member 20 may be attached to the upper target 2*a* and the target anchor member 14 may be attached to the lower target 2*b*, as illustrated in the drawings. The target support frame 12 may further include at least one target connecting member 10 which extends between the upper target 2*a* and the lower target 2*b*. In some embodiments, a pair of generally elongated, parallel, spaced-apart target connecting members 10 may extend between the upper target 2*a* and the lower target 2*b*. Each target connecting member 10 may be attached to the upper target 2*a* and to the lower target 2*b* in a manner which will be hereinafter described.

As illustrated in FIGS. 1A-3B, each target 2 includes a target body 3 which may be a rigid material such as metal or plastic, for example and without limitation. The target body 3 may be generally pan-shaped, having a circular target body front wall 4 and an annular target body side wall 5 which extends from the target body front wall 4. In other embodiments, the target body 3 may have alternative shapes. The target body front wall 4 and the target body side wall 5 may define a target interior 6. The target body front wall 4 has a front surface 4*a* (FIG. 1B) and a rear surface 4*b* (FIG. 1A) which faces the target interior 6. The front surface 4*a* of the target front wall 4 may have an appearance which is highly visible. For example, in some embodiments the front surface 4*a* may have a fluorescent orange or other color. A target mark 7 may be provided in the center area of the front surface 4*a*.

Figure 1A:
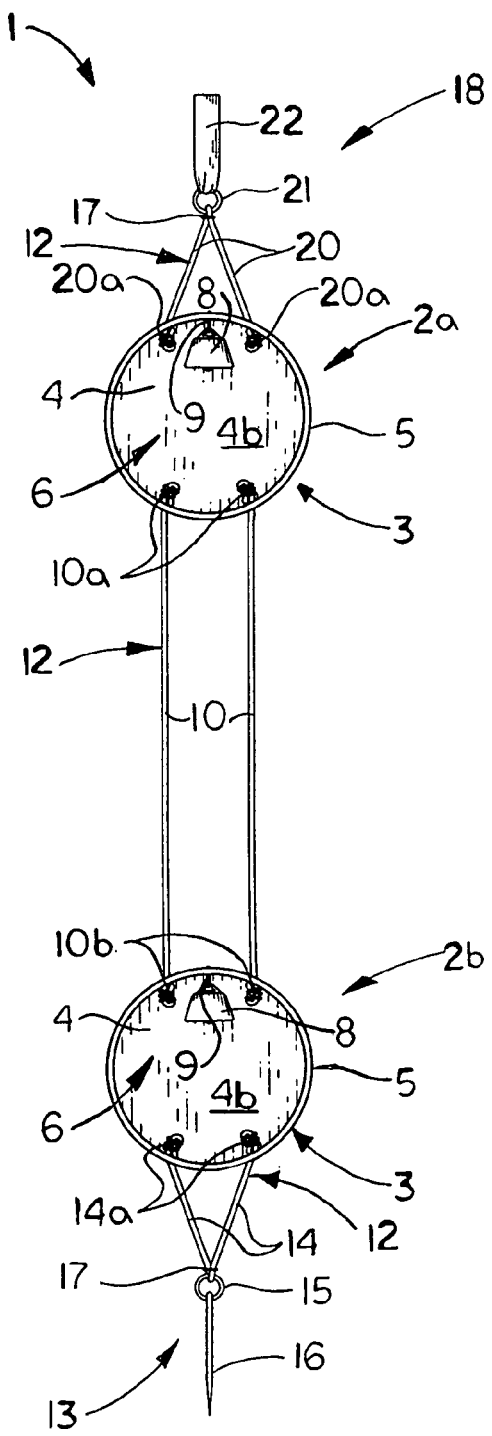
FIG. 1A is a rear view of an illustrative embodiment of the sports training device.
Figure 1B:
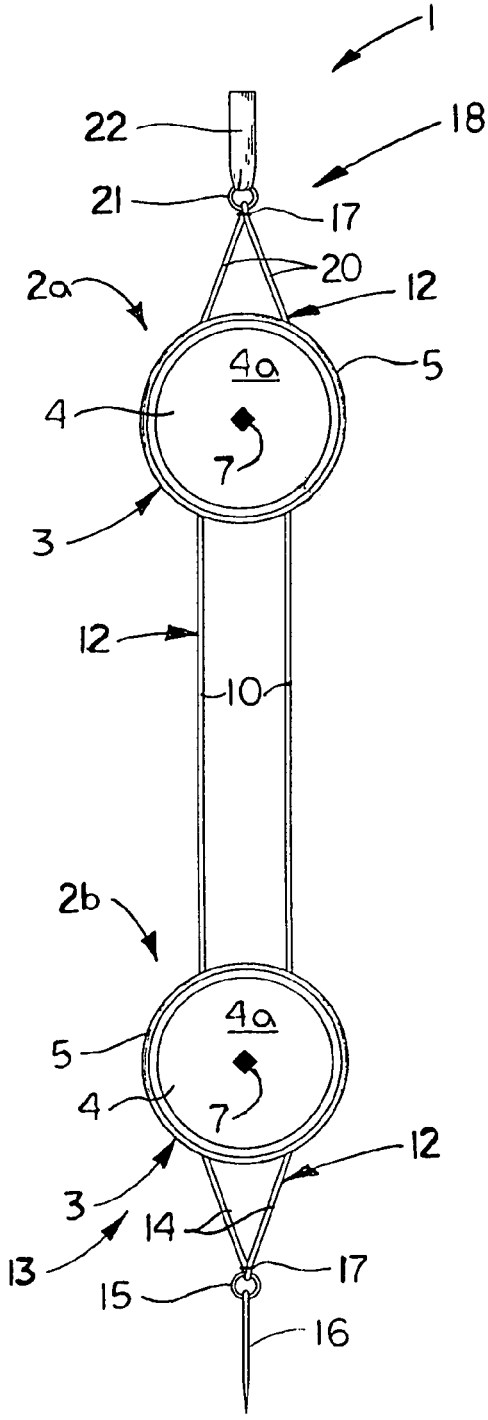
FIG. 1B is a front view of an illustrative embodiment of the sports training device.
Figure 2A:
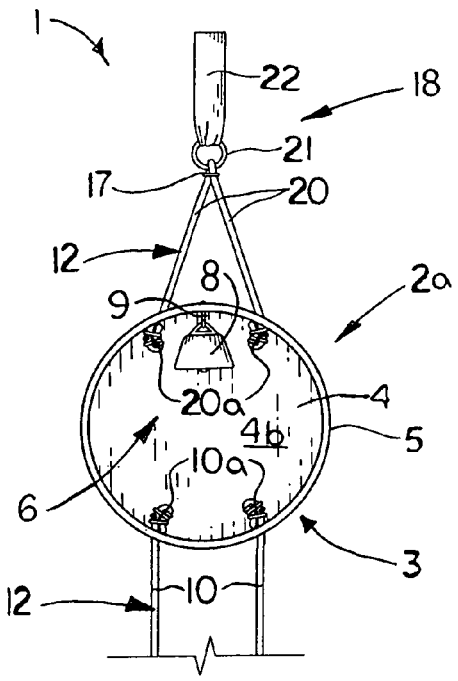
FIG. 2A is a rear view of an upper target of an illustrative embodiment of the sports training device (partially in section)
Figure 2B:
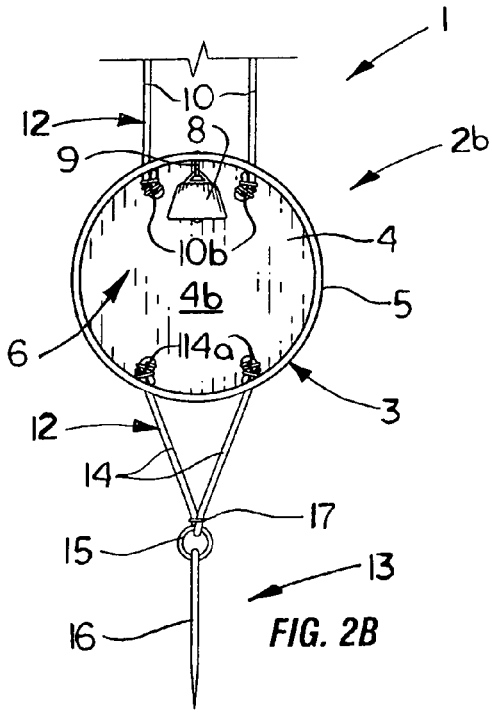
FIG. 2B is a rear view of a lower target of an illustrative embodiment of the sports training device (partially in section)

As illustrated in FIGS. 1A, 2A and 2B, in some embodiments an alarm 8 may be provided in the target interior 6 of each target 2. The alarm 8 may be any type of device which is capable of emitting a sound responsive to striking of the target 2 by a ball, hockey puck or other object (not illustrated). In some embodiments, the alarm 8 is a bell, as illustrated. The alarm 8 may be attached to the side wall 5 of the target body 3 via an alarm fastener 9 or other suitable attachment technique.

The elements of the target support frame 12 may be attached to the upper target 2*a* and to the lower target 2*b* using any suitable attachment technique which is known by those skilled in the art. As illustrated in FIGS. 1A and 2A, in some embodiments, the target suspension member 20 of the target support frame 12 may be attached to the upper target 2*a* by extending the ends of the target suspension member 20 through respective spaced-apart target suspension member openings (not illustrated) provided in the target body side wall 5 of the target body 3. At least one retainer ring 20*a* may be provided on each end of the target suspension member 20 which extends into the target interior 6 to prevent the target suspension member 20 from pulling through the target suspension member openings (not illustrated) provided in the target body 3. In like manner, an upper end of each target connecting member 10 of the target support frame 12 may be extended through a corresponding target connecting member opening (not illustrated) provided in the target body side wall 5 of the target body 3 of the upper target 2*a*. A lower end of each target connecting member 10 may be extended through a corresponding target connecting member opening (not illustrated) provided in the target body side wall 5 of the target body 3 of the lower target 2*b*. At least one upper retainer ring 10*a* may be provided on an upper end of each target connecting member 10 which extends into the target interior 6 of the upper target 2*a*. At least one lower retainer ring 10*b* may be tied on a lower end of each target connecting member 10 which extends into the target interior 6 of the lower target 2*b*. As illustrated in FIGS. 1A and 2B, the target anchor member 14 of the target support frame 12 may be attached to the lower target 2*b* by extending the ends of the target anchor member 14 through respective spaced-apart target suspension member openings (not illustrated) provided in the target body side wall 5 of the target body 3. At least one retainer ring 14*a* may be tied on each end of the target anchor member 14 which extends into the target interior 6 of the lower target 2*b*. Alternative retaining devices (not illustrated) other than or in addition to the retainer rings 10*a*, 10*b*, 14*a* and 20*a* may be provided on the respective elements of the target support frame 12 to prevent those elements from pulling out of the upper target 2*a* and the lower target 2*b*.

The sports training device 1 may be adapted for attachment to the goal frame 27 (FIG. 4) of the goal 26 using any suitable attachment technique which is known by those skilled in the art. As illustrated in FIGS. 1A, 1B, 2A and 3A, a device attachment assembly 18 may be provided on the target support frame 12 to facilitate attachment of the sports training device 1 to the goal 26. In some embodiments, the device attachment assembly 18 may include a goal attachment strap 22 which is attached to the target suspension member 20. The target suspension member 20 and the goal attachment strap 22 may each extend through a strap attachment ring 21 which secures the goal attachment strap 22 to the target suspension member 20. A cord ring 17 may encircle the diverging segments of the target suspension member 20 at the strap attachment ring 21.

Figure 3A:
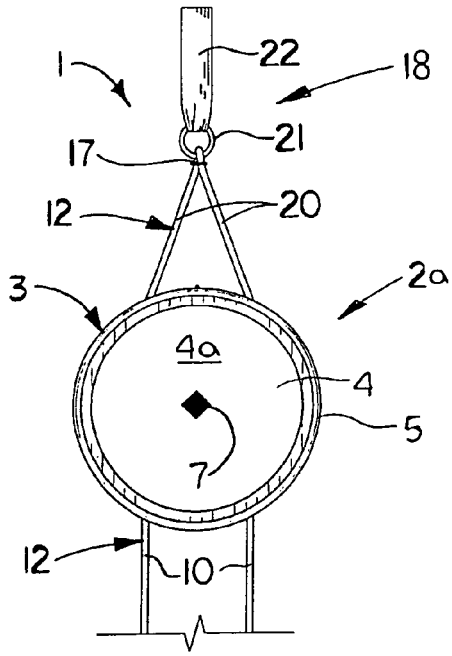
FIG. 3A is a front view of the upper target of an illustrative embodiment of the sports training device (partially in section)
Figure 3B:
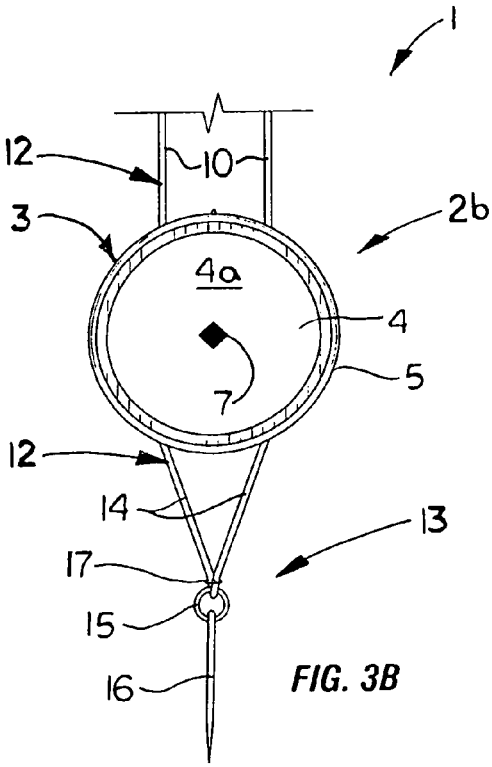
FIG. 3B is a front view of the lower target of an illustrative embodiment of the sports training device (partially in section)

The sports training device 1 may be adapted for attachment to the goal supporting surface 40 (FIG. 8) beneath the goal 26 (FIG. 4) using any suitable anchoring technique which is known by those skilled in the art. As illustrated in FIGS. 1A, 2B and 3B, a device anchor assembly 13 may be provided on the target support frame 12 to facilitate anchoring of the sports training device 1 to the goal 26. In some embodiments, the device anchor assembly 13 may include a stake 16 which is attached to the target anchor member 14 of the target support frame 12 for extension into the goal supporting surface 40. The target anchor member 14 may extend through a stake attachment ring 15. The stake attachment ring 15 may extend through a ring opening (not illustrated) provided in the stake 16. A cord ring 17 may encircle the diverging segments of the target anchor member 14 at the stake attachment ring 15.

Figure 7:
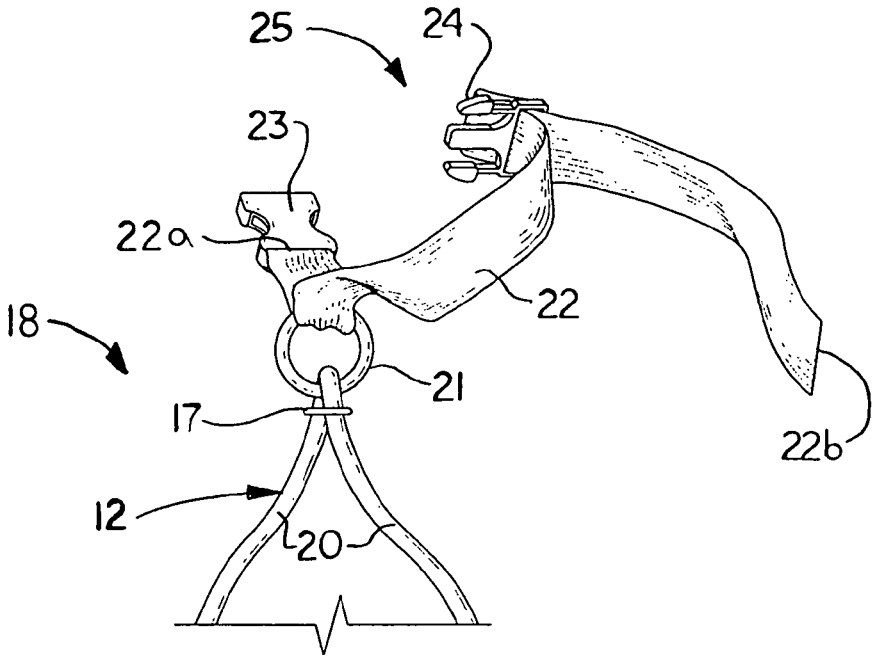
FIG. 7 is a perspective view of an illustrative goal attachment strap which is suitable for attachment of the sports training device to a goal.

As illustrated in FIG. 7, in some embodiments a strap fastening and adjusting mechanism 25 may be provided on the goal attachment strap 22 to facilitate fastening and tightening of the goal attachment strap 22 around the front goal frame member 29 (FIG. 4) or other element of the goal frame 27. The strap fastening and adjusting mechanism 25 may include a buckle receptacle 23 which is provided on a first end 22*a* of the goal attachment strap 22. A second end 22*b* of the goal attachment strap 22 may extend through a buckle insert 24. The buckle insert 24 is adapted for removable insertion in the buckle receptacle 23 to secure the goal attachment strap 22 around the front goal frame member 29 or other element of the goal frame 27. The buckle insert 24 may be slid along the goal attachment strap 22 to facilitate selective tightening and loosening of the goal attachment strap 22. Alternative strap fastening and adjusting mechanisms 25 which are known by those skilled in the art, such as hook and loop fasteners (not illustrated) and snaps (not illustrated), for example and without limitation, may be used to fasten and tighten the goal attachment strap 22 around the front goal frame member 29 or other element of the goal frame 27.

Figure 6:
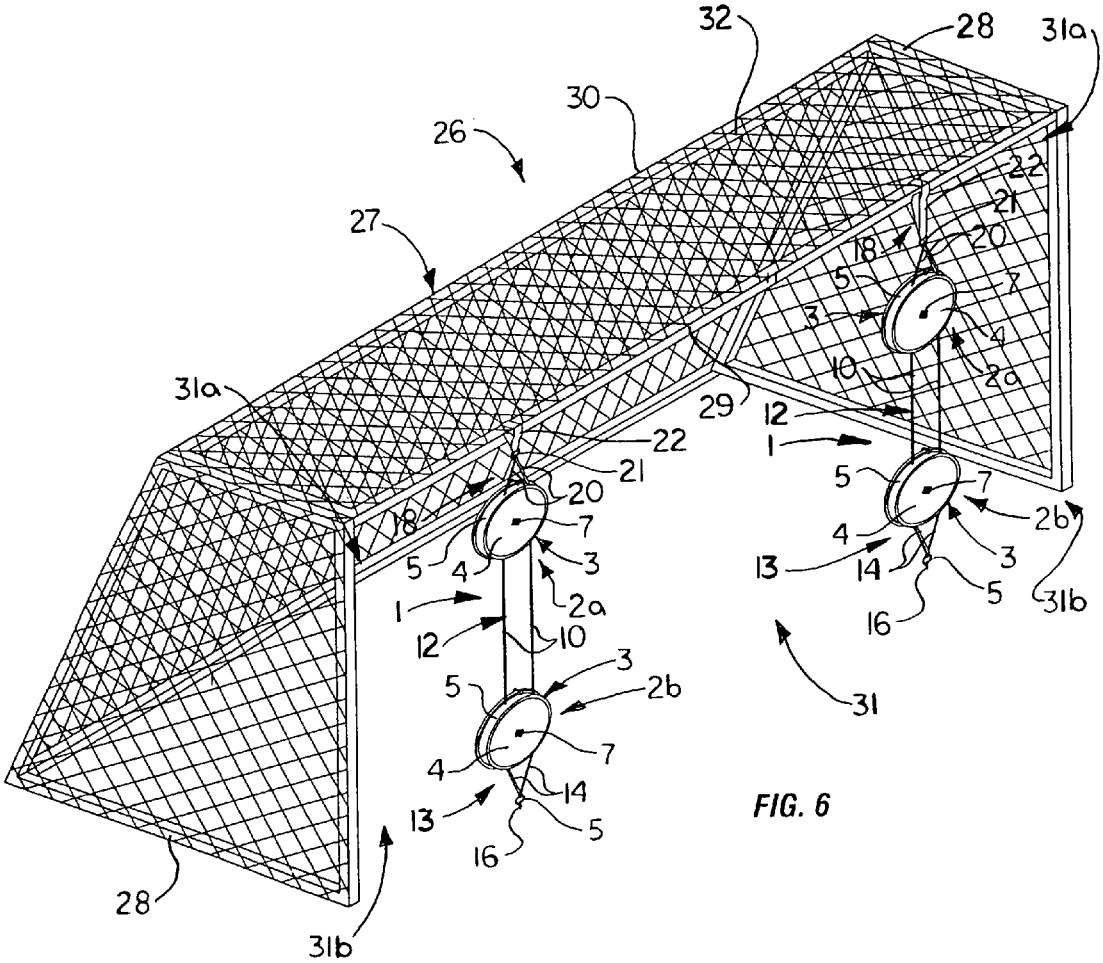
FIG. 6 is a front perspective view of a goal, with a pair of spaced-apart sports training devices deployed in a functional configuration on the goal.
Figure 8:
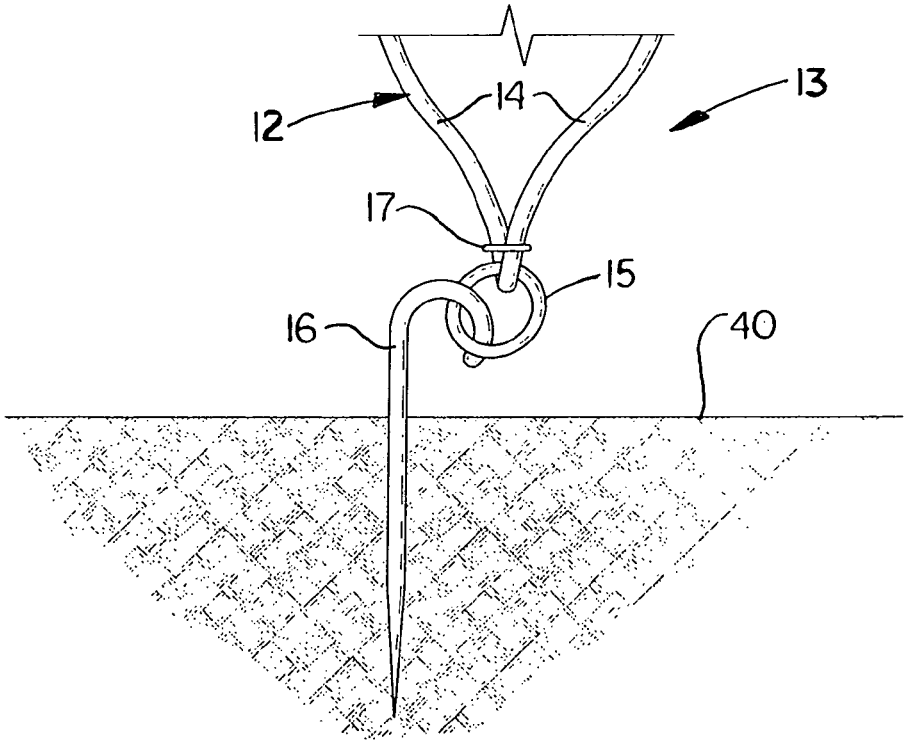
FIG. 8 illustrates an illustrative stake technique for anchoring the sports training device to the ground.

Referring next to FIGS. 4, 6 and 8 of the drawings, in typical application, at least one sports training device 1 may be attached to the goal frame 27 of a goal 26. The goal 26 may be one of two goals 26 which are used in a game of soccer, lacrosse, hockey or any other game in which players (not illustrated) on each of two opposing teams attempt to maneuver a ball, puck or other object (not illustrated) into the goal opening 31 in the goal 26 of the opposing team. Each goal 26 may rest on a goal supporting surface 40 (FIG. 8) which may be the ground or an ice rink, for example and without limitation, at a corresponding end of a playing field (not illustrated) on which the game is played. Each sports training device 1 may be attached to the goal frame 27 of the goal 26 such as by attaching the goal attachment strap 22 of the device attachment assembly 18 to the front goal frame member 29 or other element of the goal frame 27. In some embodiments, this may be accomplished by unfastening the buckle insert 24 (FIG. 7) from the buckle receptacle 23 of the strap fastening and adjusting mechanism 25; extending the goal attachment strap 22 around the front goal frame member 29; and re-inserting the buckle insert 24 into the buckle receptacle 23 of the strap fastening and adjusting mechanism 25, respectively. The goal attachment strap 22 may be selectively tightened around the front goal frame member 29 by sliding the goal attachment strap 22 through the buckle insert 24. Each sports training device 1 may be anchored to the goal supporting surface 40 by inserting the stake 16 of the device anchor assembly 13 in the goal supporting surface 40, as illustrated in FIG. 8. Accordingly, the target support frame 12 of each sports training device 1 may be stretched taut between the goal supporting surface 40 and the front goal frame member 29 or other element of the goal 26 with the upper target 2*a* and the lower target 2*b* disposed in generally vertically-spaced relationship with respect to each other in the goal opening 31.

The horizontal position of each sports training device 1 along the goal opening 31 may be adjusted to select the desired location of the upper target 2*a* and the lower target 2*b* in the goal opening 31. The positions of the upper target 2*a* and the lower target 2*b* of each sports training device 1 within the goal opening 31 may be selected to correspond to the positions which are the most difficult for a goalkeeper (not illustrated) to defend or block and deflect the ball, puck or other object (not illustrated) from the goal opening 31 during a game. In some games, the areas of the goal opening 31 which are the most difficult for a goalkeeper to defend may be the upper corners 31*a* and the lower corners 31*b* of the goal opening 31. Therefore, as illustrated in FIG. 6, in some applications a pair of sports training devices 1 may be deployed over the goal opening 31 of the goal 26, with the upper target 2*a* and the lower target 2*b* of each sports training device 1 positioned generally at or adjacent to a corresponding upper corner 31*a* and lower corner 31*b*, respectively, of the goal opening 31. A ball, puck or other object (not illustrated) may then be placed on the playing field (not illustrated), after which a player (not illustrated) may attempt to kick, throw or strike and maneuver the ball, puck or other object against the upper target 2*a* or the lower target 2*b* of one of the sports training devices 1. In the event that the ball, puck or other object strikes the front wall 4 (FIG. 1B) of the target body 3 of the upper target 2*a* or the lower target 2*b*, resulting movement of the upper target 2*a* or lower target 2*b* the alarm 8 (FIG. 1A) may be activated to indicate that the upper target 2*a* or the lower target 2*b* has been struck. Repeated attempts by the player to place the ball, puck or other object against the upper target 2*a* or the lower target 2*b* may eventually train or condition the player to maneuver the ball into an upper corner 31*a* or lower corner 31*b* of the goal opening 31 after removal of each sports training device 1 from the goal opening 31. Consequently, the player may become adept at placing the ball, puck or other object in the goal opening 31 at an upper corner 31*a* or a lower corner 31*b* thereof, rather than in a center area of the goal opening 31, resulting in fewer successful deflections of the ball, puck or other object from the goal opening 31 by a goalkeeper (not illustrated) on an opposing team as the goalkeeper defends the goal opening 31.

Figure 5A:
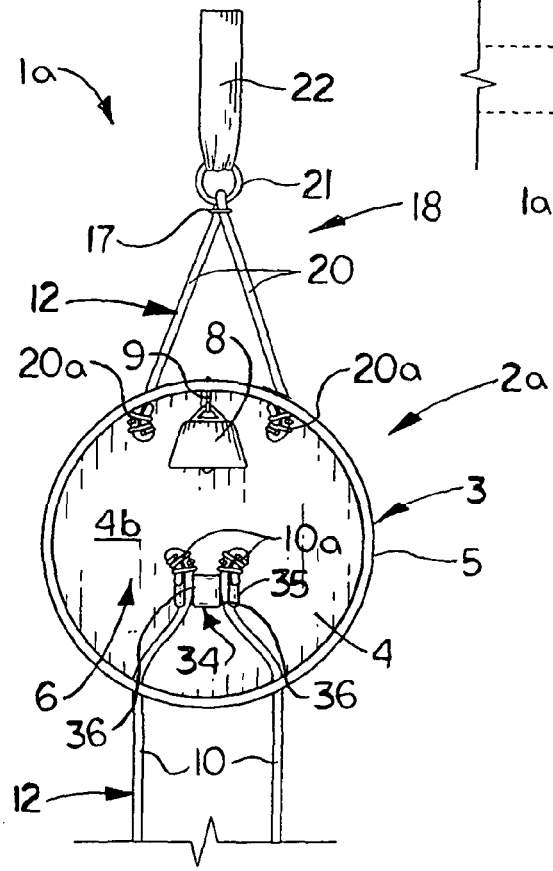
FIG. 5A is a rear view of the upper target of an alternative illustrative embodiment of the sports training device (partially in section)
Figure 5C:
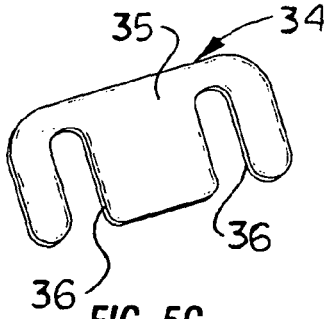
FIG. 5C is a perspective view of an illustrative cord stay which is suitable for implementation of the sports training device illustrated in FIGS. 5A and 5B.
Figure 5B:
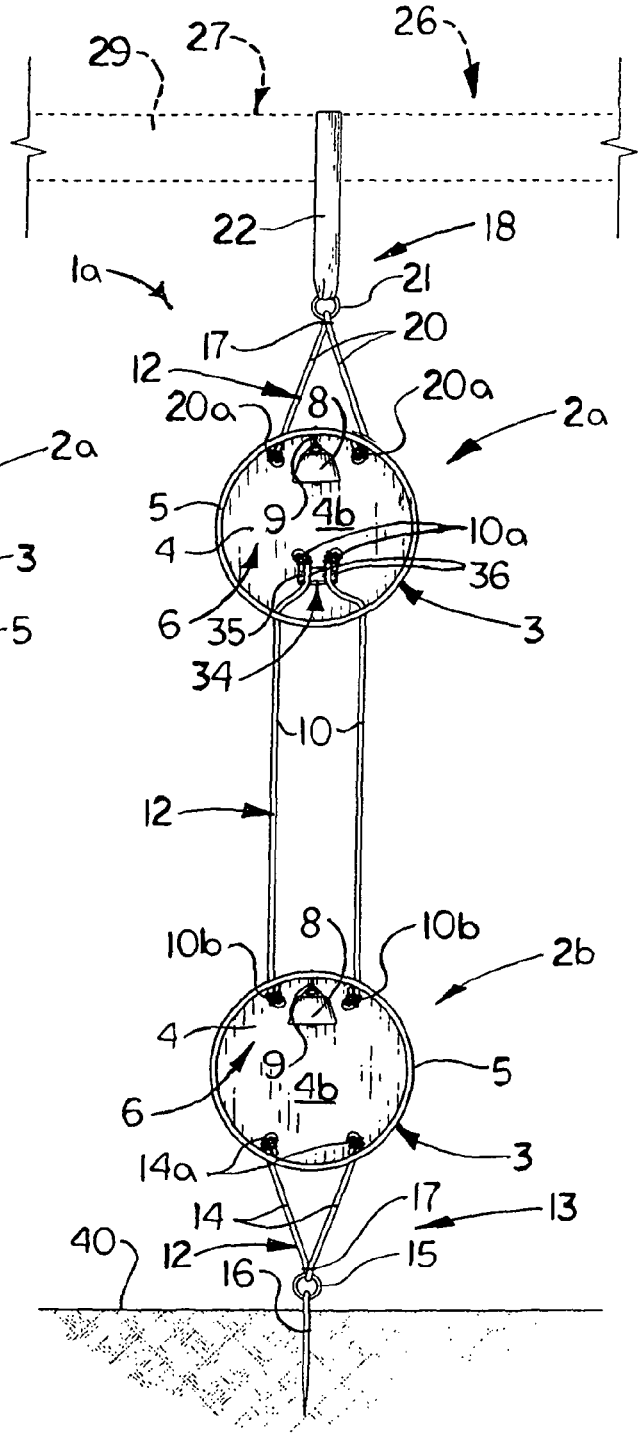
FIG. 5B is a rear view of the alternative illustrative embodiment of the sports training device illustrated in FIG. 5A, fastened to a goal (illustrated in phantom) and anchored in the ground.

Referring next to FIGS. 5A-5C of the drawings, an alternative illustrative embodiment of the sports training device is generally indicated by reference numeral 1*a*. In the sports training device 1*a*, a cord stay 34 may be provided on the end segments of the respective target connecting members 10 which extend between the upper retainer ring or rings 10*a* and the target body side wall 5 in the target interior 6 of the upper target 2*a*, as illustrated in FIGS. 5A and 5B. Additionally or alternatively, the cord stay 34 may be provided on the end segments of the target connecting members 10 which extend between the lower retainer ring or rings 10*b* and the target body side wall 5 in the target interior 6 of the lower target 2*b* (FIG. 5B). The cord stay 34 may facilitate selection of a desired length of the target connecting members 10 which extends between the upper target 2*a* and the lower target 2*b* and precise positioning of the upper target 2*a* and the lower target 2*b* at selected vertical positions in the goal opening 31 of the goal 26 by retaining a selected length of each target connecting member 10 in the target interior 6 of either or both of the upper target 2*a* and the lower target 2*b*. As illustrated in FIG. 5C, the cord stay 34 may include a rigid or semi-rigid cord stay body 35 which may be metal or plastic, for example and without limitation. A pair of spaced-apart cord slots 36 may extend into an edge of the cord stay body 35. As illustrated in FIGS. 5A and 5B, the end portions of the target connecting members 10 which extend into the target interior 6 may be inserted in the respective cord slots 36 of the cord stay 34 to prevent the ends of the target connecting members 10 from pulling out of the target interior 6 of either or both of the upper target 2*a* and the lower target 2*b* through the target connecting member openings (not illustrated) of either or both of the upper target 2*a* and the lower target 2*b*. It will be recognized and understood that the cord stay 34 which is illustrated in FIGS. 5A-5C serves as just one example of a cord stay which is suitable for retaining the target connecting members 10 in the target interior 6 of either or both of the upper target 2*a* and the lower target 2*b* and that other types of cord stays which are suitable for the purpose may be used instead.

While the preferred embodiments of the disclosure have been described above, it will be recognized and understood that various modifications can be made in the embodiments of the disclosure and the appended claims are intended to cover all such modifications which may fall within the spirit and scope of the disclosure.

What is claimed is:

1. A sports training device, comprising:

a goal having a goal frame;

a target support frame having a pair of elongated, parallel, straight, spaced-apart target connecting members carried by said goal frame of said goal;

a device attachment assembly carried by said target support frame;

a device anchor assembly carried by said target support frame;

a first target and a second target carried by said target support frame in spaced-apart relationship with respect to each other between said device attachment assembly and said device anchor assembly;

wherein said target connecting members of said target support frame extend vertically between said first target and said second target;

wherein each of said first target and said second target comprises a generally pan-shaped target body having a target interior and said target connecting members are secured in said target interior of said first target and said second target; and an alarm carried by said target body in said target interior.

2. The sports training device of claim 1 wherein said alarm comprises a bell.

3. The sports training device of claim 1 wherein said target support frame comprises a target suspension member carried by said device attachment assembly and attached to said first target and a target anchor member connecting said second target and said device anchor assembly.

4. The sports training device of claim 3 further comprising a cord stay provided on each of said target connecting members and retaining said target connecting members in said target interior of said target body of at least one of said first target and said second target.

5. The sports training device of claim 4 wherein said cord stay comprises a cord stay body and at least one cord slot provided in said cord stay body and receiving a corresponding one of said target connecting members.

6. The sports training device of claim 3 wherein said device attachment assembly comprises a goal attachment strap carried by said target suspension member of said target support frame.

7. The sports training device of claim 3 wherein said device anchor assembly comprises a stake carried by said target anchor member of said target support frame.

8. A sports training device, comprising:

a device attachment assembly including a goal attachment strap;

a target suspension member carried by said goal attachment strap of said device attachment assembly;

a first target carried by said target suspension member;

a pair of generally elongated, parallel, spaced-apart, elastic target connecting members carried by said first target;

a second target carried by said target connecting members;

a target anchor member carried by said second-target;

a device anchor assembly carried by said target anchor member;

wherein each of said first target and said second target comprises a generally pan-shaped target body having a target body front wall, a target body side wall extending from said target body front wall and a target interior defined by said target body front wall and said target body side wall;

wherein said target connecting members extend through said target body side wall of said target body of each of said first target and said second target and further comprising at least one retainer ring provided on said target connecting members, respectively, in said target interior of said target body of each of said first target and said second target;

a cord securing mechanism securing said target connecting members, respectively, in said target interior of said target body of at least one of said first target and said second target; and an alarm carried by said target body in said target interior.

9. The sports training device of claim 8 wherein said device anchor assembly comprises a stake.

* * * * *